United States Patent [19]

Reppas

[11] 4,070,715

[45] Jan. 31, 1978

[54] COMBINATION BED AND DESK

[76] Inventor: George S. Reppas, 1030 San Raymundo Road, Hillsborough, Calif. 94010

[21] Appl. No.: 727,780

[22] Filed: Sept. 29, 1976

[51] Int. Cl.[2] ..... A47C 13/18

[52] U.S. Cl. ..... 5/2 R; 5/26 R; 5/57 B; 312/241

[58] Field of Search ..... 5/213, 24–26, 5/57–59; 312/164 R, 166 R, 241, 272, 272.5

[56] References Cited

U.S. PATENT DOCUMENTS

| | | | |
|---|---|---|---|
| 3,337,879 | 8/1967 | Humphery | 5/24 |
| 3,383,716 | 5/1968 | Biancalani | 5/26 R |
| 3,386,110 | 6/1968 | Vanhentenrijk et al. | 5/3 |
| 3,732,583 | 5/1973 | Jones | 5/24 |
| 3,952,342 | 4/1976 | Hart | 5/3 |

*Primary Examiner*—Casmir A. Nunberg
*Attorney, Agent, or Firm*—Flehr, Hohbach, Test, Albritton & Herbert

[57] ABSTRACT

Combination bed and desk furniture is disclosed in which a bed frame and desk are mounted on a base for conjoint movement between raised and lowered positions. In the raised position the bed frame is pivoted upright where its bedding is concealed from view, and at the same time the desk is elevated to a standard height above the floor. In the lowered position the bed frame is pivoted to a horizontal orientation spaced above the top of the desk to provide clearance for articles left on the desk surface. In the lowered position the bed frame is lowered to standard bed height above the floor which is lower than the desk. Means are provided for simultaneously moving the bed and desk elements between the raised and lowered positions without altering the horizontal alignment of the desk and its drawers in respect to the floor. In one embodiment the outer end of the desk is supported by wheels turning in circular tracks, and in another embodiment the support is by gear wheels engaging the teeth of circular gear tracks. In this latter embodiment drive means is provided to turn the gear wheels for raising and lowering the desk and also to pivot the bed frame between its raised and lowered positions. A headboard and footboard are pivotally mounted at opposite ends of the bed frame. A light fixture is mounted in a position which will illuminate the desk in its raised position as well as the bed in its lowered position.

11 Claims, 4 Drawing Figures

COMBINATION BED AND DESK

BACKGROUND OF THE INVENTION

This invention relates in general to furniture which is convertible for different modes of use.

Convertible furniture has previously been provided as an expedient for saving floor space. For example, the well-known sofa bed provides a sofa in one mode and a bed frame and mattress in another mode. Other arrangements have been suggested to provide combination bed and table or desk furniture. U.S. Pat. No. 1,105,203 is an example of a prior art combination bed and dresser structure in which the dresser remains in an upright position regardless of whether the bed is being used. U.S. Pat. No. 307,013 provides another arrangement in which a fixed drawer unit remains upright as the bed is being folded.

Previously known convertible furniture of the type described have not provided a combination bed and desk structure which maintain a level attitude of the desk as it is moved between the bed and desk modes, and which converts between the modes without disturbing articles or other material left on the desk. Moreover, such known furniture when converted to the bed mode occupies an excessive amount of space in a room. Accordingly, the need has been recognized for an improved combination bed and desk or table which will overcome the shortcomings and limitations of existing furniture of this type.

OBJECTS AND SUMMARY OF THE INVENTION

It is a general object of the invention to provide new and improved combination bed and desk or table furniture.

Another object is to provide furniture of the type described which is convertible into one mode in which a mattress is at a standard height for use as a bed, and into another mode in which a desk top is at a standard height for use as a desk.

Another object is to provide combination bed and desk furniture of the type described in which the desk is carried in a level orientation throughout its movement between the bed and desk modes of use.

Another object is to provide combination bed and desk furniture of the type described in which the bed frame in its lowered position is spaced above the desk top so that articles and other material can be left on the desk undisturbed.

Another object is to provide combination bed and desk furniture of the type described in which illumination is provided for both the bed in its lowered position and the desk in its raised position.

Another object is to provide combination bed and desk furniture of the type described which provides drive means for moving the bed and desk between their raised and lowered positions.

The invention in summary includes a bed frame and desk which are mounted together for conjoint movement on a base between raised and lowered positions. In the raised position the bed frame is upright while the desk top is raised to a standard desk height from the floor, and in the lowered position the bed frame and its mattress are disposed horizontally and at standard bed height from the floor. The desk is supported for movement in a level attitude between its raised and lowered positions. In one embodiment drive means is provided for moving the bed and desk. A light fixture is mounted above the base so as to illuminate both the bed in its lowered position and the desk in its raised position.

The foregoing and additional objects and features of the invention will become apparent from the following description in which the preferred embodiments have been set forth in detail in conjunction with the accompanying drawings.

DESCRIPTION OF THE PREFERRED EMBODIMENTS

Figure 1:
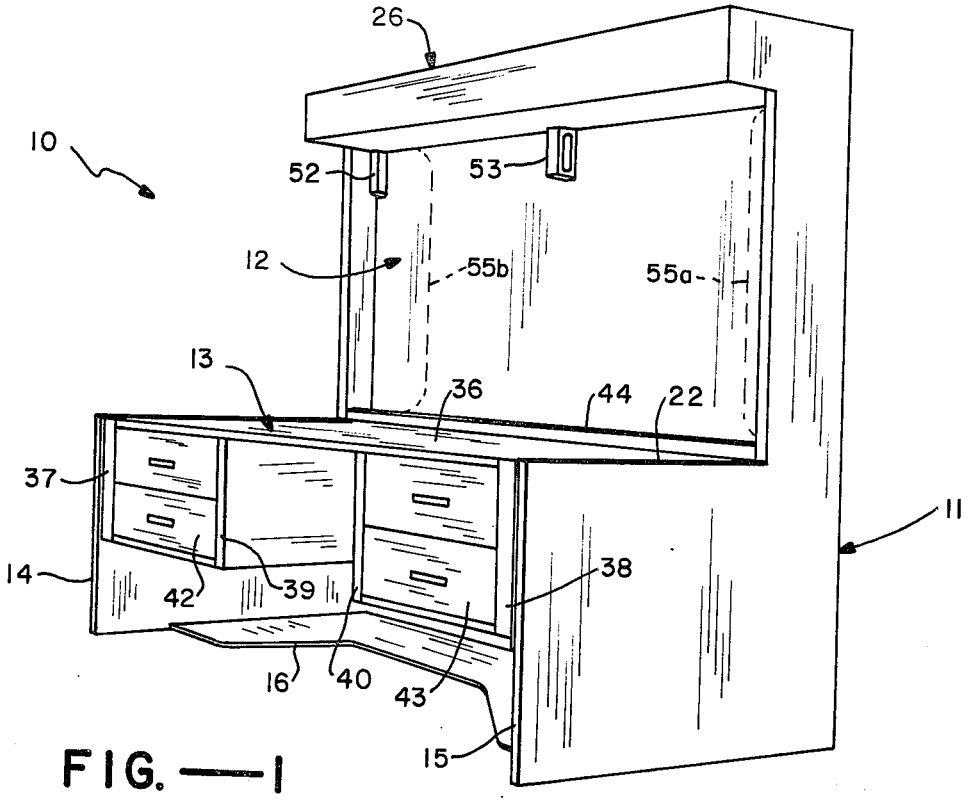
FIG. 1 is a perspective view of the combination bed and desk unit of the invention shown in use as a desk.
Figure 2:
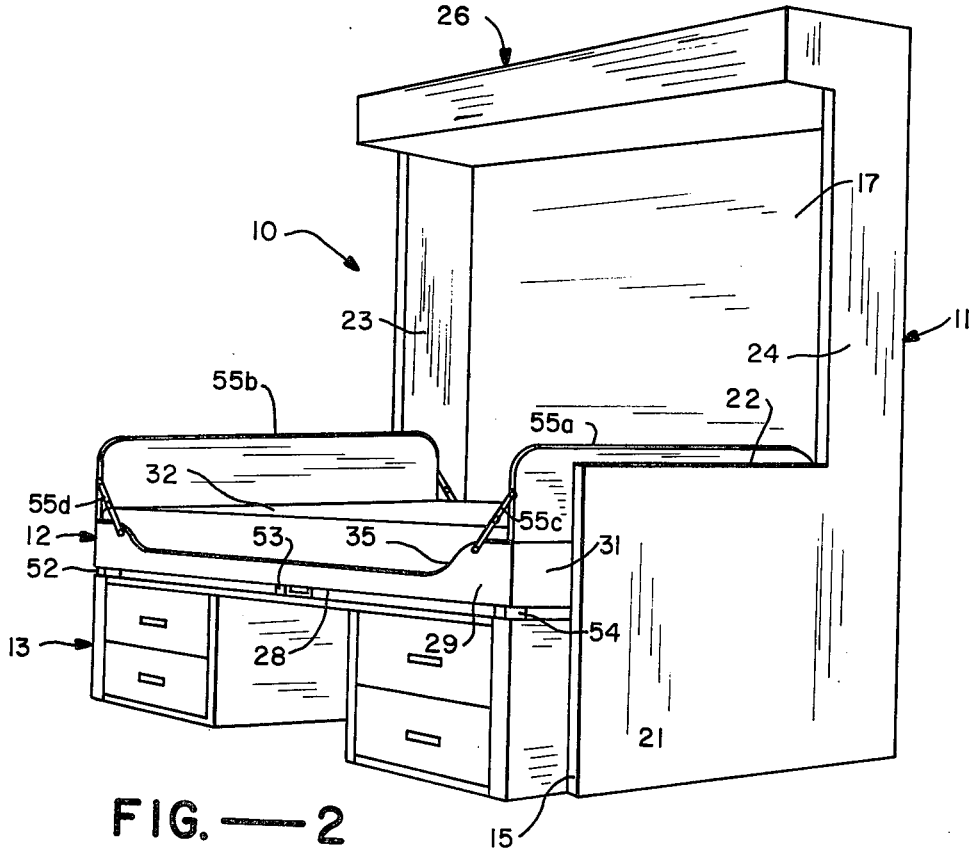
FIG. 2 is a perspective view similar to FIG. 1 showing the unit converted for use as a bed.
Figure 3:
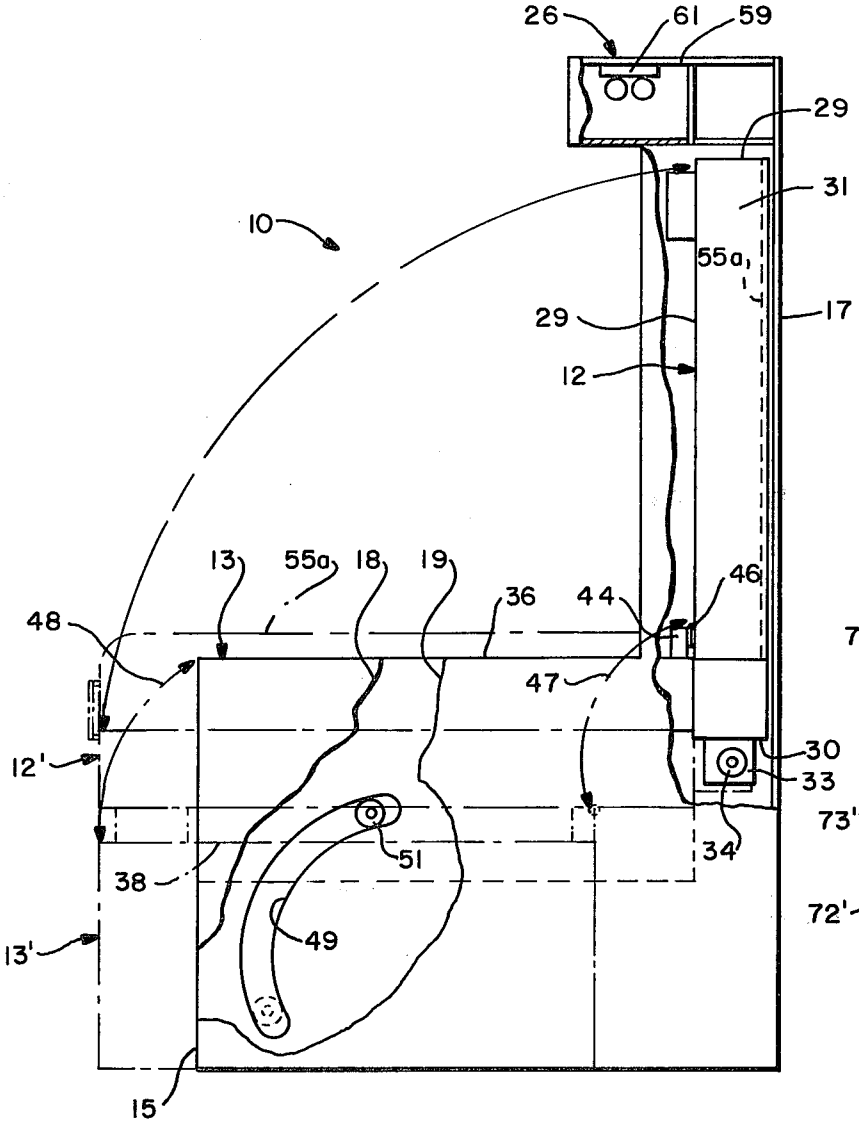
FIG. 3 is a side elevational view of the combination bed and desk unit of FIG. 1.

In the drawings FIGS. 1–3 illustrate generally at 10 a combination bed and desk furniture unit made in accordance with the invention. Furniture unit 10 includes a support frame or base 11 which carries a bed 12 and desk 13. Base 11 preferably is of wood construction and is adapted for standing on a floor or other flat support surface. The base includes two upright laterally spaced sidewalls 14, 15 joined together at the back by a rear wall 17. A floor panel 16 is mounted between the lower edges of the two sidewalls. The typical sidewall 15 includes a pair of spaced-apart inner and outer panels 18, 19 the outer edges of which are covered by narrow strips 21, 22. Elongate portions 23, 24 at the back of the sidewalls extend upwardly where they are joined together by a transverse box-section light fixture housing 26.

The bed 12 includes a frame 27, preferably of wood construction, formed with a bottom wall 28 and four sidewalls 29, 30, 31 which define an open rectangular enclosure for holding the bedding 32. A cutout 35 is formed along the outer sidewall 29 to facilitate ingress and egress to and from the bed. A pair of brackets 33 are mounted at opposite ends of the rear sidewall 30 of the bed frame, and pivot connections 34 are carried by these brackets to mount the bed frame on the base for pivotal movement about a transverse axis. The bed moves about the transverse axis between the raised position in which it is upright as shown in solid line of FIG. 3, and the lowered position shown in phantom at 12' in FIG. 3. In the lowered position the bed frame is in a horizontal orientation and the bedding is at a standard height on the order of 25 inches for use as a bed. In the raised position the bedding is completely concealed from view between the raised sidewalls. The bottom wall 29 of the bed frame is preferably formed with an attractive finish for aesthetic appeal when the furniture is used as a desk.

The desk 13 is also preferably of wood construction and includes a flat horizontally disposed desk top 36 from which depend a pair of side panels 37, 38 as well as a pair of inner panels 39, 40. The inner panels are spaced apart a sufficient width to form room for the legs of an individual seated at the desk. Suitable pull-out drawers 42, 43 are mounted for sliding movement between the side and inner panels. An elongated rail 44 is mounted at the rear of the desk top and serves to prevent articles on the desk top from falling over its rear edge.

The desk 13 is mounted for movement with the bed frame through means which includes a pivot connection 46. The connection 46 comprises a plurality of hinge joints mounted between rail 44 on the inner end of the desk and bottom wall 29 of the bed frame. The connection 46 is spaced at a radius from bed frame pivot connection 34 so that the hinge joints are carried through an arc 47 as the frame is moved between its raised and lowered positions. In the desk configuration the desk top is disposed above the floor at a standard height on the order of 30 inches.

The outer end of the desk is supported for movement through an arc 48 of a radius equal to that of arc 47 so that the desk top maintains a level orientation as it is moved between its raised and lowered positions. In the embodiment illustrated in FIGS. 1–3 this support means includes arcuate openings formed through each of the inner panels 18 of the base sidewalls to form circular tracks 49 having a radius equal to the radius of movement of pivot connection 46. Follower means is provided for movement in each track and comprises two wheels 51 rotatably mounted on and extending outwardly from respective side panels 37, 38 of the desk. The wheels are mounted for rolling movement along the tracks for supporting and guiding the desk through its arc of travel. The means for supporting the outer end of the desk could also comprise a pair of arms each pivotally mounted at one end to the desk in place of the wheels and pivotally mounted at their opposite ends to the base.

The bed frame and desk are sized and balanced so that the desk, and thereby the bed frame, can be easily manually raised and lowered. The desk and bed frame are retained in their raised position as a result of the wheels 51 reposing at a 12 o'clock or overcenter position on track 49 such that the weight of the bed frame and desk creates a force moment tending to urge these components toward the back of the unit, i.e. clockwise as viewed in FIG. 3. This force can be easily overcome by manually pulling the desk outwardly from the overcenter position so that the weight of the desk and bed frame tends to pivot the components forward or counterclockwise as the wheels roll down to the bottom of the tracks.

Two posts 52 and 54 are mounted on and extend downwardly from the outer end corners of bottom wall 28 on the bed frame. A combination handle and center post 53 is similarly mounted on the bottom wall between the corner posts. The three posts are of the same height as rail 44 and coact with the rail to support the bed frame in spaced relationship above desk top 36. Writing materials or other articles may thereby be left on the desk without being disturbed when the unit is converted into the bed configuration. Because the desk maintains its level orientation throughout its movement between the bed and desk modes, the materials and other articles are not scattered about. Additionally, center post 53 forms a handle which the user can grip to convert the unit between its two modes.

A headboard 55*a* is mounted by a suitable hinge on one sidewall 31 of the bed frame, and a footboard 55*b* is similarly mounted by a hinge on the opposite sidewall 32. As shown in FIG. 2, the headboard and footboard are positioned upright when the bed frame is horizontal, and they are releasably locked in the orientation by means of pairs of articulated brace arms 55*c*, 55*d* which are connected with the outer sidewall 29 of the bed frame. The headboard and footboard are unlocked and pivoted inwardly against the bedding when the bed is raised to its upright position, thereby assisting in holding the bedding in place.

Light fixture housing 26 includes a top wall 56, a pair of spaced apart transverse panels 57, 58 and a bottom panel 59 of a suitable transparent material such as glass. A light fixture 61, preferably comprising one or more fluorescent light tubes 62 carried on a mounting base, is mounted below the upper wall of housing 26 along the length of the transparent panel. The housing 20 is positioned to project forward of the bed frame when in its upright position so that the light illuminates the entire desk surface. With the unit 10 converted to a bed, the light fixture also provides illumination for purposes such as reading in bed.

In the use and operation of the invention it will be assumed that the furniture unit 10 is initially in the desk mode as illustrated in FIG. 1. In this mode desk top 36 is at a standard height above the floor to provide ample leg room for an individual seated at the desk. The bedding 36 contained within the upright bed frame is concealed from view and stowed so as to occupy a minimum of floor space.

To convert the unit to the bed mode the user pulls handle 53 forward to start the wheels 51 rolling down track 49, and thereafter the bed frame and desk continue to move by their own weight toward the lowered position illustrated in FIG. 2. At the start of this movement the bed frame 12 pivots about connection 34 in a counterclockwise direction as shown in FIG. 3. At the same time hinge joint 46 carries the inner end of the desk through its arc of travel 47 concurrent with movement of the wheels along track 49 so that the desk maintains a level attitude. When the wheels reach the bottom of the tracks the bedding is horizontal and at a height which is standard for conventional beds. For converting back to the desk mode the user lifts up on the bed to move the wheels upwardly along the track. This carries the desk in its level attitude and also applies a force movement through hinge joint 46 to pivot the bed frame back to its upright position.

Figure 4:
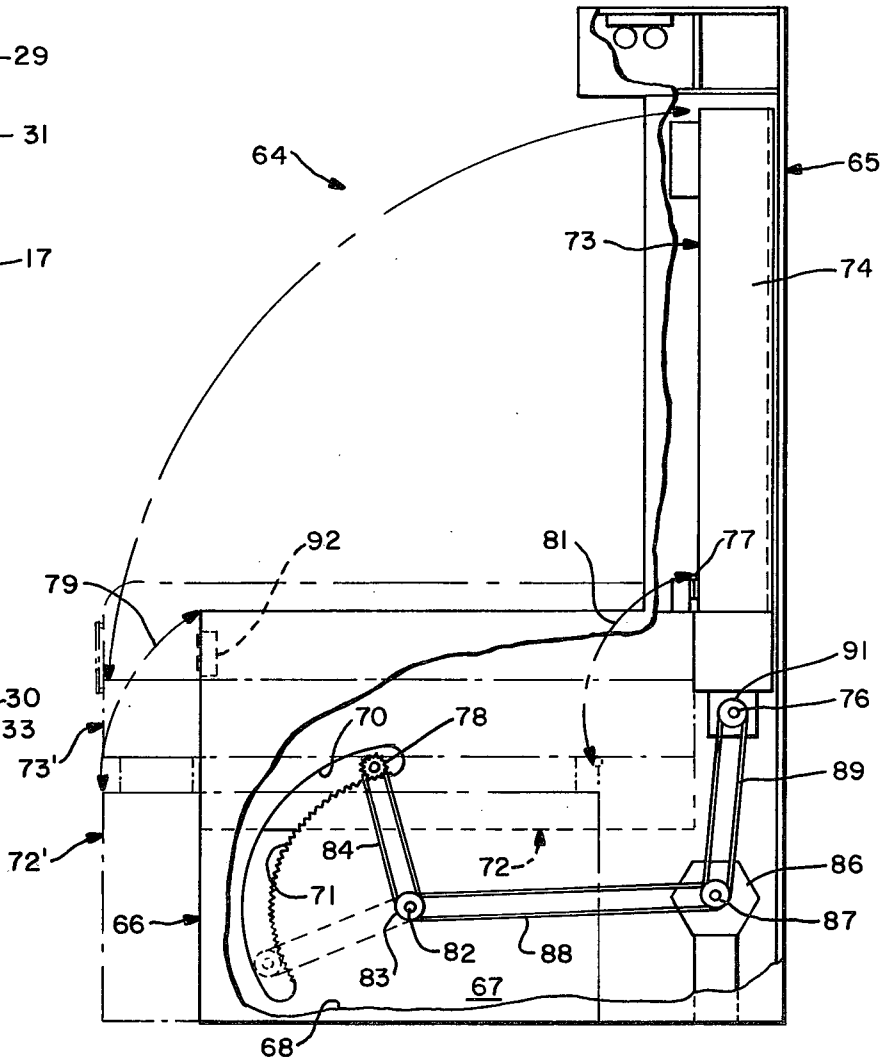
FIG. 4 is a side elevational view of another embodiment of the invention.

FIG. 4 illustrates another embodiment of the invention in which drive means is provided for converting the furniture unit 64 between its bed and desk modes. In this embodiment the unit 64 includes a base 65 which is provided with a pair of sidewalls 66 each of which includes inner and outer panels 67, 68. The construction of the sidewalls is similar to that described for the embodiment of FIGS. 1–3 except that an arcuate opening 70 is formed in the inner panels with a circular gear track 71.

A desk 72 and bed 73 of similar construction to that described for the embodiment of FIGS. 1–3 are mounted between the base sidewalls 66. The bed includes a frame 74 mounted at its lower end for pivotal movement about transverse axis 76, and the inner end of the desk is carried on the bed frame through a hinge joint 77. A pair of spur gears 78 are rotatably mounted on and extend outwardly from the side panels of desk 72 in engagement with gear tracks 71 to move the outer end of the desk through an arc 79 having a radius equal to the radius of arc 81 through which the hinge joint moves.

A drive shaft 82 is mounted between the panels of sidewall 66 on an axis concentric with gear track 71. A drive sprocket 83 is mounted for rotation on shaft 82 and a driven sprocket, not shown, is mounted for rotation with spur gear 78. An endless chain 84 is trained about the drive and driven sprockets. A suitable drive motor 86, preferably an electric motor, is mounted within the lower end of base 65 and the output shaft of the motor rotates a sprocket 87 and endless chain 88 which in turn drives a sprocket, not shown, mounted for rotation on shaft 82. The motor output shaft further drives another sprocket, not shown, and endless chain 89 which extends upwardly for engagement about a driven sprocket 91 mounted for rotation with the bed frame about axis 76. The invention contemplates that other drive arrangements, such as drive belts, could be employed in place of the endless chains. Motor 86 is actuated through means of an on/off push-button control box 92 mounted in the upper end of base sidewall 66.

In the operation of the embodiment of FIG. 4 it will be assumed that furniture unit 64 is initially in the desk mode illustrated in solid line in FIG. 4. Push-button control 92 is operated to power motor 86 and turn its drive shaft in a counterclockwise direction as viewed in FIG. 4. The motor drive shaft operates through chain 89 and sprocket 91 to pivot bed frame toward its lowered position thereby carrying hinge joint 77 and the desk downwardly. Simultaneously chain 88 drives sprocket 83 which in turn drives gear wheel 78 through chain 84. The gear wheel climbs down the teeth of track 71 to carry the outer end of the desk through arc of travel 79 so that the desk moves in a level attitude toward the lowered position 72'. A suitable limit switch, not shown, is provided for sensing the limits of travel of the bed frame, or of the desk, for deactivating the motor when the fully raised and fully lowered positions are reached. For returning the unit to its bed mode push-button control 92 is actuated to reversely operate motor 86 which in turn pivots the bed in a clockwise direction while simultaneously turning gear wheel 78 clockwise. The gear wheel climbs up the gear track and thereby carries the desk in a level attitude toward its raised position.

While the foregoing embodiments are presently considered to be preferred it is understood that numerous variations and modifications may be made therein by those skilled in the art and it is intended to cover in the appended claims all such variations and modifications as fall within the true spirit and scope of the invention.

What is claimed is:

1. Combination bed and desk furniture comprising a bed frame for holding bedding, means for carrying the frame at one of its ends for pivotal movement about a transverse axis between a raised position in which the frame and bedding are disposed in an upright orientation and a lowered position in which the frame and bedding are disposed in a horizontal orientation, a desk having a top surface disposed in a generally horizontal orientation, means for mounting the desk for movement with the bed between a raised position and a lowered position concurrent with movement of the bed between its respective raised and lowered positions, said last mentioned means maintaining the desk surface in said horizontal orientation throughout movement of the desk, said desk in its raised position being elevated a height above an underlying floor which affords space under the desk top for the legs and feet of an individual when seated at the desk.

2. Combination bed and desk furniture as in claim 1 in which the means for mounting the desk includes joint means connecting the inner end of the desk for pivotal movement relative to a portion of the bed frame, said joint means being moveable through an arc about said transverse axis as the bed is moved between its raised and lowered positions, and support means for carrying the outer end of the desk through an arc concurrent with movement of the joint means through its arc for maintaining said horizontal orientation of the desk top.

3. Combination bed and desk furniture as in claim 2 in which the means carrying the frame includes a base and the support means comprises means in the base forming a circular track bridging said arc of movement of the outer end of the desk, and follower means carried by the outer end of the desk and moveable therewith along the circular track.

4. Combination bed and desk furniture as in claim 3 in which the follower means comprises a guide wheel rotatably mounted on the outer end of the desk and mounted for rolling contact along the track.

5. Combination bed and desk furniture as in claim 2 in which the means carrying the frame includes a base, and the support means comprises means in the base forming a circular gear track bridging said arc of movement of the outer end of the desk, together with a gear wheel rotatably mounted on the outer end of the desk and engaging the gear track.

6. Combination bed and desk furniture as in claim 5 and including means for rotatably driving the gear wheel along the gear track whereby the desk and bed frame are conjointly moved between their raised and lowered positions.

7. Combination bed and desk furniture as in claim 1 which includes drive means for pivoting the bed frame about said transverse axis for conjointly moving the bed frame and desk between their raised and lowered positions.

8. Combination bed and desk furniture as in claim 1 which includes means for supporting said bed frame in vertically spaced relationship above the desk top when the bed frame is in its lowered position whereby materials or objects can be carried on the desk top without interference with the bed frame.

9. Combination bed and desk furniture as in claim 1 which includes light fixture means for illuminating the bed in the lowered position and for illuminating the desk top in the raised position.

10. Combination bed and desk furniture comprising a base which is standable on a floor or other surface, a bed frame for holding bedding, means for mounting one end of the frame on the base for pivotal movement about a transverse axis between a raised position in which the frame and bedding are disposed in an upright orientation and a lowered position in which the frame and bedding are disposed in a horizontal orientation, a desk having a horizontal top surface, means for mounting an inner end of the desk for pivotal movement on the frame at a radius from said axis whereby said desk end is carried through an arc about the axis, and means for supporting and guiding the outer end of the desk on the base for movement through an arc conjointly with said movement of the inner end through its arc whereby the desk surface maintains a horizontal orientation throughout its movement.

11. Combination bed and desk furniture as in claim 10 which includes a headboard pivotally mounted at one side of the frame and a footboard pivotally mounted at an opposite side of the frame, said headboard and footboard being pivotable to generally upright positions when the frame is in its lowered position and being pivotable to positions generally parallel with and adjacent the bedding when the frame is in its raised position.

* * * * *